United States Patent [19]

Nickels

[11] 4,324,529

[45] Apr. 13, 1982

[54] AXIAL-CENTRIFUGAL FLOW IMPELLER

[75] Inventor: Aubrey G. Nickels, Dunwoody, Ga.

[73] Assignee: General Electric Co., Schenectady, N.Y.

[21] Appl. No.: 159,981

[22] Filed: Jun. 16, 1980

[51] Int. Cl.[3] ..... F04D 29/28

[52] U.S. Cl. ..... 416/187; 416/213 R; 416/228; 415/DIG. 1

[58] Field of Search ..... 416/188, 178, 187, 213 R, 416/224, 228; 415/DIG. 1

[56] References Cited

U.S. PATENT DOCUMENTS

| | | | |
|---|---|---|---|
| 1,250,681 | 12/1917 | Sheldon | 416/187 X |
| 1,985,705 | 12/1934 | Whiton, Jr. | 416/224 X |
| 2,083,833 | 6/1937 | Derry | 416/187 |
| 2,287,853 | 6/1942 | Allardice | 416/224 X |
| 3,104,050 | 9/1963 | Coward | 416/184 X |
| 3,159,106 | 12/1964 | Schumbacker | 416/213 X |
| 3,398,883 | 8/1968 | Ariewitz | 416/224 |

FOREIGN PATENT DOCUMENTS

| | | | |
|---|---|---|---|
| 2039630 | 8/1980 | United Kingdom | 416/178 |

*Primary Examiner*—Leonard E. Smith

*Attorney, Agent, or Firm*—Joseph B. Forman

[57] ABSTRACT

In an axial-centrifugal flow impeller, a deflector ring is interposed between the impeller hub and the peripheral cage blades in order to redistribute the air flow discharged from the hub region of the impeller along the entire axial length of each impeller blade thereby eliminating air flow concentration at, and premature wear of, the root portions of the impeller blades. A 45°-angle weld fillet ramp is annularly defined along the radially inner juncture of the deflector ring and the impeller support plate for simultaneously deflecting the air flow radially outwardly and axially rearwardly, along with the deflector ring, in a non-turbulent manner. Hard surfacing material is weld deposited over the deflector ring and fillet ramp for partial protection purposes as well as for forming guide vanes aligned with the impeller blades, and hard surfacing material is also deposited upon the trailing edge portions of the blades for increasing the wear resistant properties thereof.

12 Claims, 6 Drawing Figures

AXIAL-CENTRIFUGAL FLOW IMPELLER

FIELD OF THE INVENTION

The present invention relates generally to blower wheel type impellers or fans, and more particularly to an improved dual-axial-centrifugal flow blower wheel of the squirrel-cage type.

BACKGROUND OF THE INVENTION

Dual-axial centrifugal flow blower wheel impellers or fans of the squirrel-cage type are of course well-known, and a conventional impeller of this type is exemplified in FIG. 1, the same being generally designated by the reference character 10. The impeller is seen to comprise, for each direction of axial air flow, a bell-shaped, annular hub member 12 co-axially secured to one side of a support plate 14 which is disposed at an axially central location of the impeller 10. The hub members 12 may be secured to support plate 14 by conventional means, such as, for example, rivet-type fasteners 16. Annular plates or end rings 18 are disposed axially fowardly and rearwardly of central support plate 14, and a plurality of axially extending, arcuately-configured blades 20 are fixedly secured between each of the end plates 18 and the central support plate 14 in a peripheral arrangement. The blades 20 may likewise be secured to plates 14 and 18 by rivet fasteners 22.

During use and operation of the impeller 10, the hub members 12 are of course fixedly secured to the drive shaft, not shown, of a driving motor, also not shown, whereby the impeller 10 is caused to rotate, for example, in the direction as depicted by arrow A. As a result of such rotational movement, air flow is axially induced into the impeller 10 from both ends thereof, in opposite directions, and centrifugally discharged in a radially outward manner. This air flow pattern has thus accounted for the nomenclature of these types of fans or impellers as dual-axial-centrifugal flow blower wheels.

Bell-shaped hub members 12 are commonly employed within axial-centrifugal flow blower wheels because of the laminar, nonturbulent air flow patterns efficiently generated during the process of altering the air flow from its axial induction path to its radial discharge path. As can further be appreciated, most of the air flow leaving the hub members 12 and being discharged toward the peripheral blades 20 will encounter the blades at their root ends, that is, the ends of the blades adjacent central support plate 14. While this air flow pattern may ostensibly seem to be innocuous, in fact, it has been observed that when, for example, the impellers 10 are employed as exhaust means for air flows containing abrasive particles, the concentration of the air flow at the root end portions of the blades 20 has deleteriously affected the structural integrity of the impeller blades 20 by causing premature wear of such blade portions. Consequently, the expected service lives of these impellers have been substantially foreshortened.

OBJECTS OF THE INVENTION

Accordingly, it is an object of the present invention to provide a new and improved axial-centrifugal flow blower wheel or impeller.

Another object of the present invention is to provide a new and improved axial-centrifugal flow blower wheel or impeller whereby the aforenoted operational disadvantages of conventional axial-centrifugal flow impellers are overcome.

Still another object of the present invention is to provide a new and improved axial-centrifugal flow blower wheel or impeller wherein the structural integrity of the impeller blades is sustained even when the air stream with which the impeller is being employed contains abrasive particals.

Yet another object of the present invention is to provide a new and improved axial-centrifugal flow blower wheel or impeller wherein the useful service lives of such impellers is substantially greater than those of conventional impellers.

A further object of the present invention is to provide a new and improved axial-centrifugal flow blower wheel or impeller wherein the aforenoted advantages of the present invention may be simply and economically achieved.

A still further object of the present invention is to provide a new and improved axial-centrifugal flow blower wheel or impeller wherein the teachings of the present invention may advantageously be applied to conventional axial-centrifugal flow blower wheels or impellers in order to beneficially modify the operational characteristics of such conventional impellers.

SUMMARY OF THE INVENTION

The foregoing and other objects are achieved in accordance with the present invention through the provision of deflecting means, secured to both sides of the central support plate in the instance of a dual-axial-centrifugal flow impeller or to the fan-interior side of a similar end support plate of a single-axial-centrifugal flow impeller, for simulaneously deflecting the induced air flow radially outwardly and axially rearwardly, that is, in the axial direction opposite that of the original induced flow. In this manner, in lieu of the air flow being concentrated substantially at the root end portions of the impeller blades, the air flow is substantially uniformly distributed along the entire axial length of each impeller blade. Consequently, abrasive wear of the impeller or fan blades occurs substantially uniformly along the entire axial length of each fan blade as opposed to solely within the root end region of each blade. As a result of this wear distribution pattern, the service life of each blade, and therefore that of the entire impeller, is substantially increased.

The particular deflecting means of the present invention comprises an annular metal ring coaxially disposed about the hub member or members of the impeller unit such that the ring is radially interposed between the hub member or members and the peripherally arranged impeller blades. The ring member or members are welded to the central or end support plate of the particular impeller, and in order to provide a laminar flow of air over the ring member or members as the air is discharged from the hub member or members, each ring is provided with a 45° weld fillet ramp on the side of the ring which faces the hub member. Hard surfacing material may also be weld deposited over the ring and weld fillet, at circumferentially spaced locations aligned with the impeller blades, in order to protect the weld fillet and deflecting ring components as well as to serve as vane means for properly orienting and distributing the air flow towards the impeller blades. In a similar manner, hard surfacing material may likewise be weld deposited upon the trailing edge of each impeller blade in order to prevent premature wear of such blade portions which are particularly susceptible to abrasive wear by means of the abrasive particles within the air streams being processed as a result of the fluid flow characteristics of such air streams.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE PREFERRED EMBODIMENT

Figure 1:
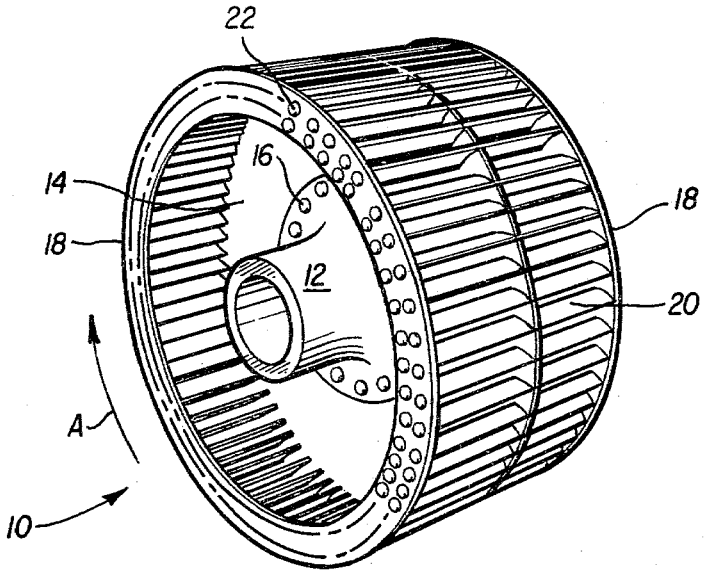
FIG. 1 PRIOR ART
FIG. 1 is a perspective view of a conventional dual-axial-centrifugal flow impeller with which the improvement of the present invention is concerned.
Figure 2:
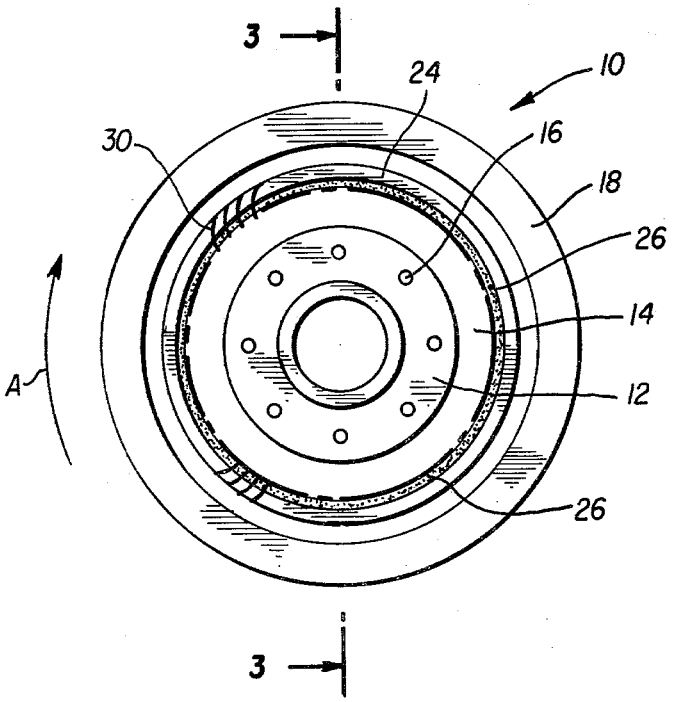
FIG. 2 is a front elevation view of the impeller of FIG. 1 as modified in accordance with the present invention and showing the cooperative component parts thereof.

Referring now to the drawings, and more particularly to FIGS. 2–5 thereof, there is shown a dual-axial-centrifugal flow impeller 10 similar to that shown in FIG. 1. It is to be initially noted herein that while the present invention is being disclosed and particularly illustrated in connection with a dual-axial-centrifugal flow impeller, wherein, as noted in conjunction with the description of the impeller of FIG. 1, supra, the impeller comprises two hub members 12 secured upon opposite sides of a central support plate 14, two end plate members 18, and two sets of impeller blades 20 fixedly interposed between plate 14 and the end plates 18, the present invention may likewise be applicable to a single-axial-centrifugal flow impeller which, in effect, would comprise a single hub member 12 secured to one side of plate 14, one end plate 18 disposed axially upstream of hub member 12 and plate 14, and one set of impeller blades 20 fixedly interposed between plates 14 and 18.

In accordance with the present invention, in order to eliminate the concentration of the air flow discharged by means of the hub members 12 toward the root end portions of the impeller blades 20, that is, those end portions of the blades disposed adjacent central support plate 14, a deflecting means, comprising an annular ring member 24, is secured upon the opposite surfaces of central support plate 14 so as to coaxially surround the hub members 12. Each ring member 24 is disposed at a radial position between hub member 12 and the peripheral cage defined by means of blades 20, and in this manner, the ring members 24 can advantageously intercept the radially outward, centrifugal air flow generated by means of the hub members 12.

Figure 3:
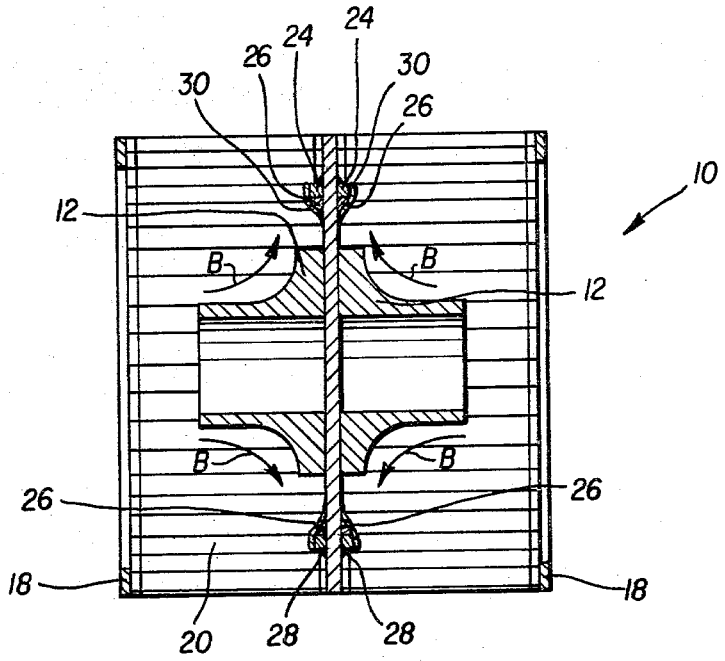
FIG. 3 is a cross-sectional view of the impeller of FIG. 2 as taken along line 3—3 of FIG. 2.

The ring members 24 are secured to central support plate 14 by conventional welding processing, however, in order to properly re-orient and re-distribute the air flow discharged from hub members 12, as noted by the arrows B in FIG. 3, such that the resulting air flow streams are substantially uniformly distributed along the entire lengths of the impeller blades 20, a 45°-angle weld fillet ramp 26 is annularly formed between the radially inner juncture of each ring member 24 and the central support plate 14. As can additionally be appreciated from FIG. 5, the resulting air flow streams, as depicted by the arrows C, comprise conjunctive radially outward and axially rearward components whereby the desired airstream flow patterns may in fact be achieved. The annular weld defined between the radially outer juncture of each ring member 24 and central support plate 14 may comprise a single weld bead as noted at 28.

Each ring member 24 may be fabricated as an annular preform of any suitable metal compatible with that conventionally employed in fabricating central support plate 14, or alternatively, the ring members 24 may comprise metal rod or bar stock of such a compatible metal which is subsequently bent into an annular form. The cross-section of each ring member should comprise a square or rectangular configuration in order to facilitate the welding of the same to the central support plate 14.

In order to partially protect the deflector weld fillet ramp 26, as well as the deflector ring 24, from the abrasive effects of the abrasive particles entrained within the airstreams being processed by means of the impeller 10, hard surfacing material may be weld deposited over the ring members 24 and the weld fillet ramps 26 in accordance with conventional hard surfacing weld deposition techniques. As is well known, such hard surfacing processing provides the treated components with increased wear resistance properties.

Figure 4:
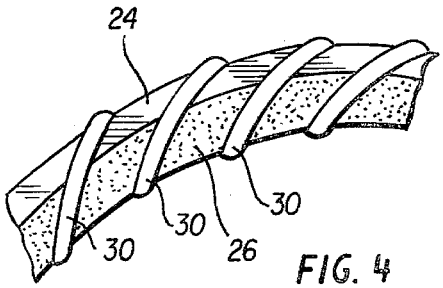
FIG. 4 is an enlarged view of the circled portion of FIG. 2 showing in detail the hard surfacing material weld deposited over the weld fillet and deflecting ring of the impeller.
Figure 5:
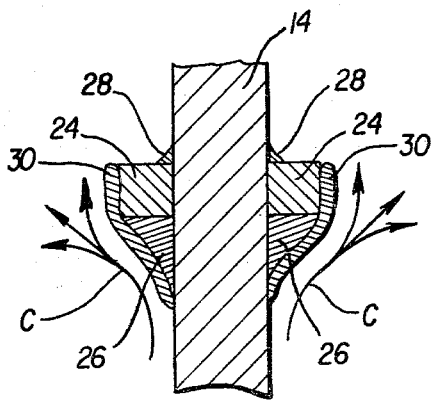
FIG. 5 is an enlarged view of the circled portion of FIG. 3 showing in detail the manner in which the deflecting ring of the present invention is welded to the impeller support plate, and wherein further, the hard surfacing material is applied to the deflecting ring and weld fillet.

In accordance with the present invention, the hard surfacing material is not only utilized for wear resistant protection purposes, but as may be further appreciated from FIGS. 4 and 5, the material 30 is deposited over the weld fillet ramp 26 and deflector ring 24, at circumferentially spaced locations aligned with the impeller blades 20, in the form of weld beads which are disposed at angles approximating 30° with respect to the radii of the impeller unit. In this manner, the arcuate weld beads 30 serve as deflector guide vanes for orienting the airstreams toward the impeller blades 20. Thus, it may be fully appreciated that as a result of the interdisposition of the deflector ring assembly means, comprising the deflector ring 24, weld fillet ramp 26, and the hard surfacing weld guide vanes 30, between the hub members 12 and the peripheral cage impeller blades 20, the desired air flow distribution patterns, relative to the impeller blades 20, may be achieved. In this regard, it is further noted that by means of the provision of weld fillet ramps 26, turbulent flow over the deflector rings 24 and through the channels defined by the circumferentially arranged hard surfacing weld guide vanes 30 is prevented.

Figure 6:
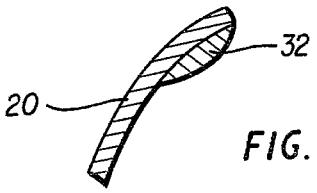
FIG. 6 is an enlarged cross-sectional view of an impeller blade showing the deposition of the hard surfacing material upon the trailing edge thereof.

Lastly, in accordance with the present invention, in order to prevent any deterioration in the structural integrity of the trailing edge portions of the impeller blades 20, which portions thereof are particularly susceptible to abrasive wear due to the air flow thereover of the abrasive particles entrained within the airstreams, and as dictated by the fluid flow characteristics of the airstreams, the trailing edge portions of the impeller blades 20 also have hard surfacing material 32 deposited thereon upon the concave sides or surfaces of such arcuately configured blades as depicted in FIG. 6.

Obviously, many modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. In an axial-centrifugal flow impeller including a support plate, at least one hub member fixedly secured to one surface of said support plate, at least one end plate disposed axially upstream of said at least one hub member, and at least one set of impeller blades fixedly secured between said at least one end plate and said support plate and disposed in a peripheral array about said at least one hub member, the improvement comprising:

deflector means, secured to said one surface of said support plate and radially interposed between said at least one hub member and said at least one set of impeller blades, for deflecting the air flow, discharged by said at least one hub member, radially outwardly and axially rearwardly toward said axially upstream at least one end plate and redistributing said air flow along the entire axial length of each of the impeller blades of said at least one set of impeller blades.

2. The improved impeller as set forth in claim 1, further comprising:

hard surfacing means disposed upon the trailing edge portions of said impeller blades of said at least one set of impeller blades for increasing the wear resistant properties of said trailing edge portions of said impeller blades.

3. The improved impeller as set forth in claim 1, wherein:

said impeller comprises a single hub member, a single end plate, and a single set of impeller blades, whereby a single-axial-centrifugal flow impeller is defined.

4. The improved impeller as set forth in claim 1, wherein:

said impeller comprises two hub members secured to opposite surfaces of said support plate, two end plates disposed axially upstream of said two hub members, respectively, and two sets of impeller blades respectively secured between said end plates and said opposite surfaces of said support plate, whereby a dual-axial-centrifugal flow impeller is defined.

5. The improved impeller as set forth in claim 1, wherein:

said deflector means comprises an annular deflector ring coaxially surrounding said at least one hub member.

6. The improved impeller as set forth in claim 5, wherein:

said deflector means further comprises ramp means, defined between said deflector ring and said one surface of said support plate, for deflecting said air flow over said deflector ring in a non-turbulent manner.

7. The improved impeller as set forth in claim 6, wherein:

said ramp means is defined by means of an annular weld fillet deposited at the juncture of said deflector ring and said one surface of said support plate.

8. The improved impeller as set forth in claim 6, wherein:

said ramp means is disposed at an approximate 45° angle with respect to said one surface of said support plate.

9. The improved impeller as set forth in claim 6, further comprising:

means defining guide vanes, fixedly secured upon said deflector ring and said ramp means, for guiding said air flow toward said impeller blades of said at least one set of impeller blades.

10. The improved impeller as set forth in claim 9, wherein:

said guide vanes are defined by means of hard surfacing material weld deposited over said deflector ring and said ramp means.

11. The improved impeller as set forth in claim 9, wherein:

said guide vanes are disposed in a circumferentially spaced array aligned with said impeller blades of said at least one set of impeller blades.

12. The improved impeller as set forth in claim 9, wherein:

said guide vanes are disposed at an approximate 30° angle with respect to the radii of said impeller.

* * * * *